US007134148B2

(12) United States Patent
Shiue

(10) Patent No.: US 7,134,148 B2
(45) Date of Patent: Nov. 14, 2006

(54) SWIM MASK

(75) Inventor: Chih-Cheng Shiue, Taipei (TW)

(73) Assignee: QBAS Co., Ltd., Taipei (TW)

( * ) Notice: Subject to any disclaimer, the term of this patent is extended or adjusted under 35 U.S.C. 154(b) by 0 days.

(21) Appl. No.: 10/971,103

(22) Filed: Oct. 25, 2004

(65) Prior Publication Data

US 2006/0107446 A1 May 25, 2006

(30) Foreign Application Priority Data

Sep. 29, 2004 (TW) ..... 93215457 U

(51) Int. Cl.
*A61F 9/02* (2006.01)

(52) U.S. Cl. ..... 2/428; 351/43

(58) Field of Classification Search ..... 2/428, 2/429, 445, 446; 351/43
See application file for complete search history.

(56) References Cited

U.S. PATENT DOCUMENTS 5,819,321 A * 10/1998 Wang ..... 2/428
6,092,895 A * 7/2000 Sato et al. ..... 351/43
6,192,523 B1 * 2/2001 Pan ..... 2/428
6,276,794 B1 * 8/2001 Chiang ..... 351/43
6,349,419 B1 * 2/2002 Chiang ..... 2/428
6,349,420 B1 * 2/2002 Chiang ..... 2/428
6,405,384 B1 * 6/2002 Chiang ..... 2/428
6,473,909 B1 * 11/2002 Chou ..... 2/428

* cited by examiner

*Primary Examiner*—Katherine Moran
(74) *Attorney, Agent, or Firm*—Troxell Law Office, PLLC

(57) ABSTRACT

A compact, waterproof swim mask having a unitary skirt, a frame, and a clinging device. The unitary skirt has two lenses for covering the eyes and/or the nose of a user, a flexible frame including two eye-shaped frame elements being capable of communicating with each other. Each frame element is bendable to slightly enlarge when an upper portion is pulled away from a lower portion so that the two frame elements communicate through a gap of a separable intermediate portion for mounting the skirt. The frame also has two endpieces for coupling a rear headband therebetween. The clinging device is secured to the separable intermediate portion of the frame by snapping for fastening the whole swim mask.

6 Claims, 4 Drawing Sheets

SWIM MASK

FIELD OF THE INVENTION

The present invention relates to goggles or masks for swimming, diving, and athletic sports and more particularly to a swim mask having a skirt and lens assembly removably connected to a flexible frame.

BACKGROUND OF THE INVENTION

A mask for swimming, diving, or athletic sports should be waterproof, light-weight, and low friction, and have an aesthetically pleasing design.

A conventional swim mask, shown in FIG. 1, includes a main frame A, an auxiliary frame B, an annular skirt C, and lens (lenses) D in which the skirt C and the lens D are sandwiched and fastened together when the rear main frame A and the front auxiliary frame B are snapped together. A connection between skirt C and lens D is waterproof. Finally, a headband (not shown) is provided between both endpieces of the main frame A. The headband is formed of elastomeric material and its length is adjustable to accommodate users with different head sizes.

However, the prior art has several disadvantages, including: (1) either the main frame A or the auxiliary frame B has a thickness to sufficiently clamp the skirt C and the lens D together therebetween; (2) the swim mask is bulky and thick and in turn increases the weight of the swim mask and thus bears a heavy burden upon a head of a user; (3) a swimmer wearing such a swim mask may not be agile while swimming, diving, etc; and (4) the large and thick swim mask is not visually aesthetic.

Another conventional design has the skirt and the lens formed together in the manufacturing process, which improved the waterproof feature. However, in use, a crack tends to occur at a joining portion of the skirt and the lens after a short period of time. It is understood that lens is hard. Thus, it is difficult to fit a formed skirt and lens in a light, compact frame. As such, commercially available swim masks still have a skirt and lens sandwiched and fastened between main and auxiliary frames that are snapped together.

In view of above, continuing improvements in the exploitation of swim mask are constantly being sought.

SUMMARY OF THE INVENTION

It is the objective of the present invention to provide a waterproof, light-weight, and easily assembled swim mask in which a skirt and lenses are formed together by over-molding, a frame is flexible and includes two eye-shaped frame elements each being bendable and resilient to enlarge when mounting the skirt thereto. The frame having two frame elements with a gap therebetween such that by slightly pulling an upper portion away from a lower portion, and a clinging device is connected to an intermediate portion of the frame.

The present invention provides a swim mask having a unitary skirt having two lenses fitted therein for covering the eyes and/or the nose of a user; a flexible frame including two eye-shaped frame elements communicating with each other wherein each frame element is bendable resilient to slightly enlarge by pulling the upper portion away from the lower portion for mounting the skirt, and two endpieces coupled to a headband; and a clinging device connected to the separable intermediate portion of the frame.

One objective of the present invention is to provide a flexible frame of a swim mask in which the frame has two eye-shaped frame elements capable of communicating with each other such that a user may slightly pull the upper portion of each of the frame members away from the lower portion for mounting of the unitary "skirt and the lenses" therein.

Another objective of the present invention is to provide a clinging device for a swim mask in which the clinging device connected to the separable intermediate portion of the frame after the unitary skirt and the lenses is inserted into the frame.

A further objective of the present invention is to provide a clinging device for a swim mask in which the clinging device is shaped to connect to edges of the separable intermediate portion of the frame after mounting the unitary skirt and the lenses in the frame.

The above and other objects, features and advantages of the present invention will become apparent from the following detailed description taken with the accompanying drawings.

DETAILED DESCRIPTION OF THE PREFERRED EMBODIMENTS

Figure 1:
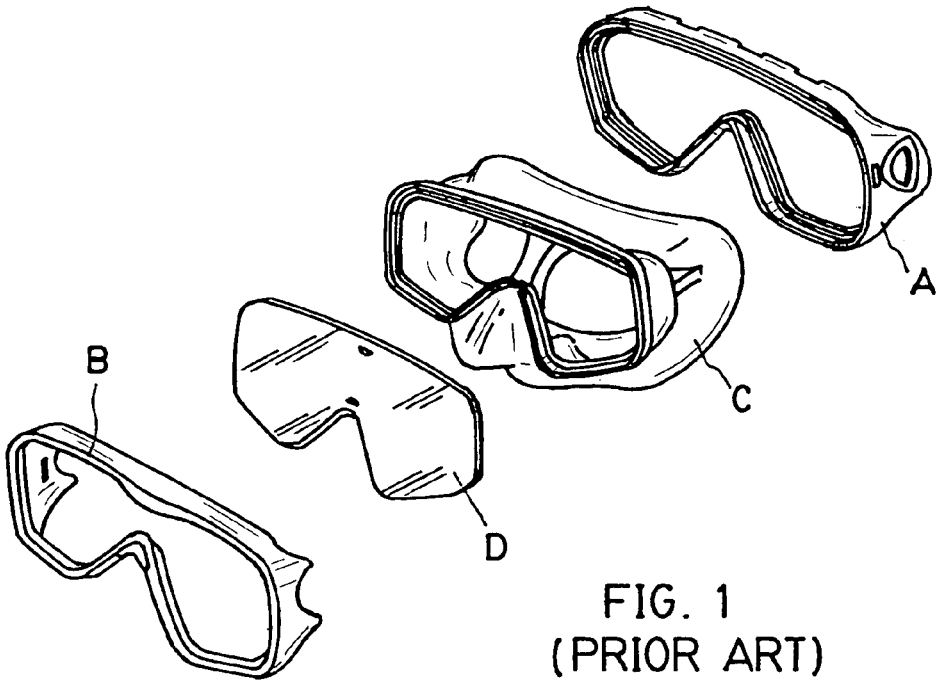
FIG. 1 (PRIOR ART)
FIG. 1 is an exploded view of a conventional swim mask.
Figure 2:
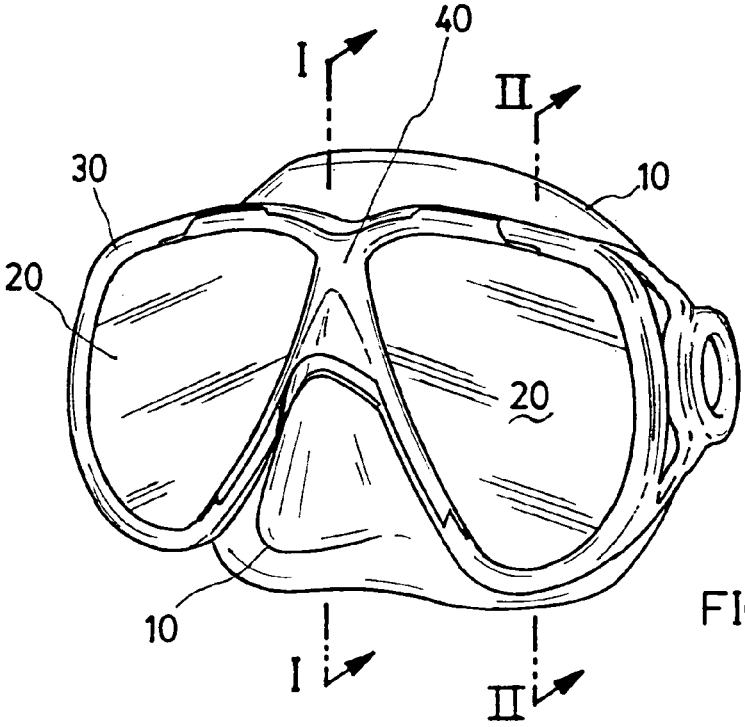
FIG. 2 is a perspective view of a preferred embodiment of the swim mask according to the present invention.
Figure 3:
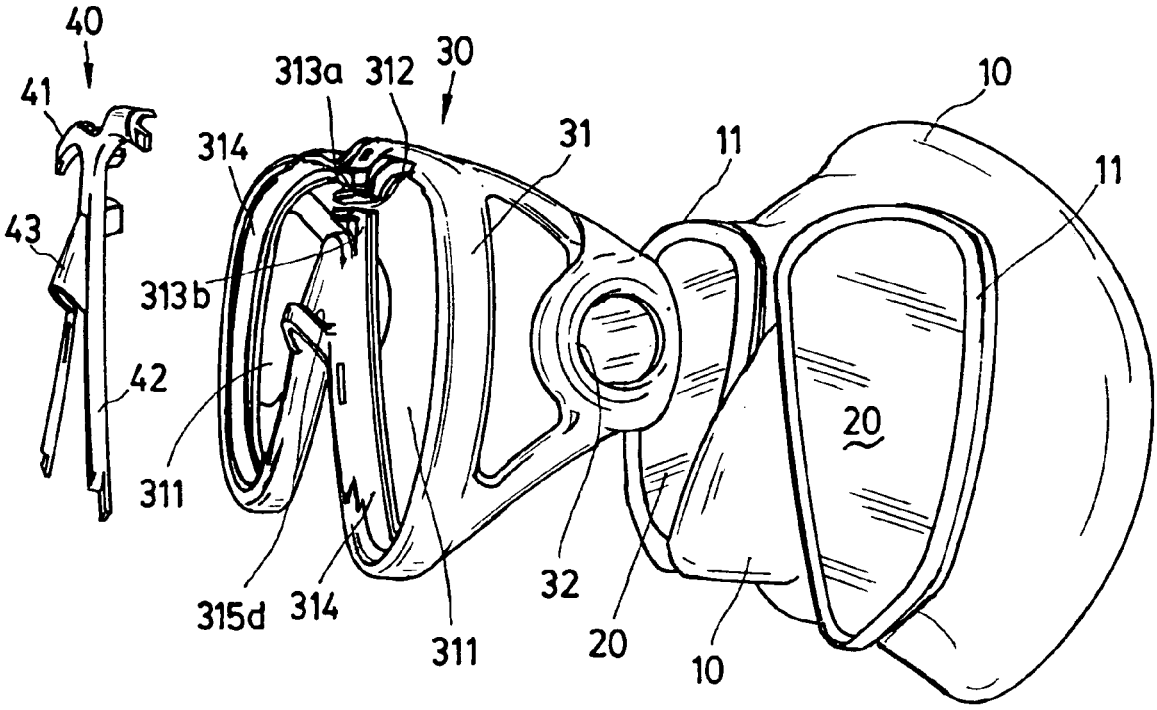
FIG. 3 is an exploded view of the swim mask shown in FIG. 2.
Figure 4:
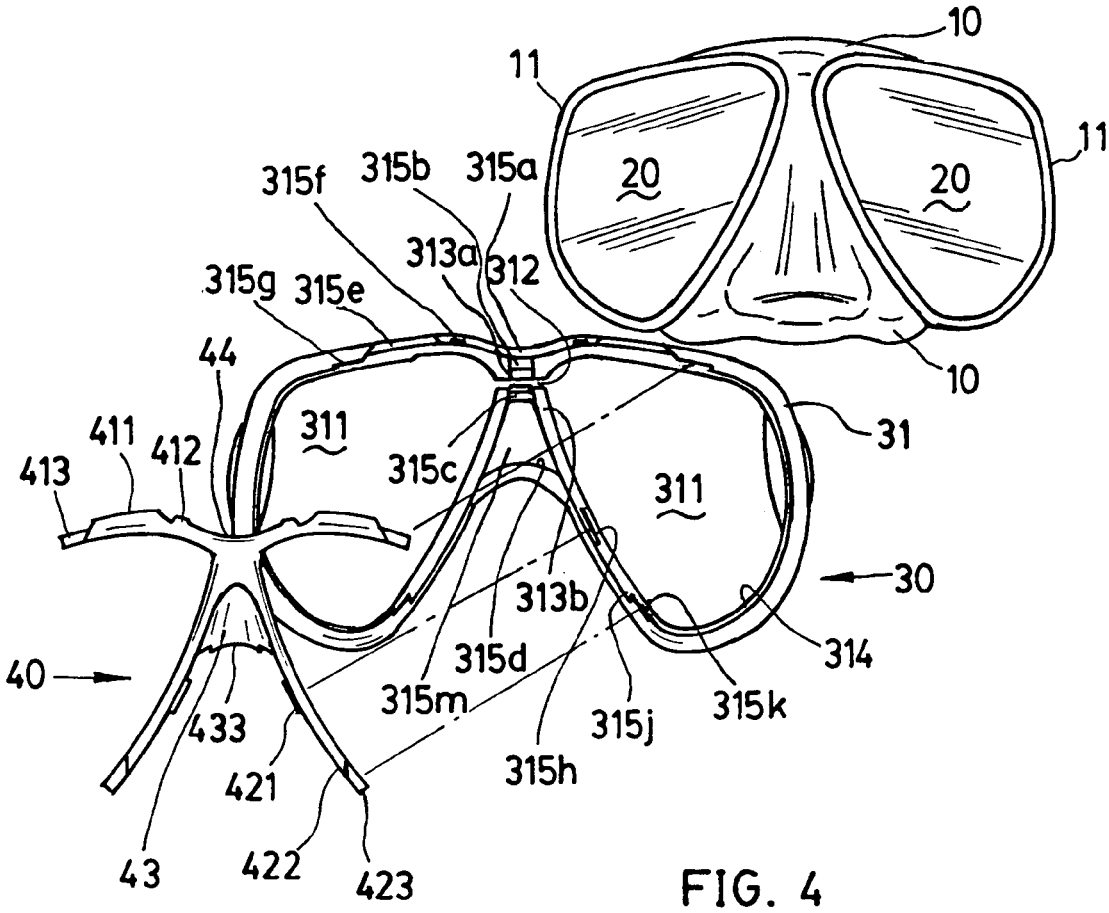
FIG. 4 is another view depicting the components shown in FIG. 3.
Figure 5:
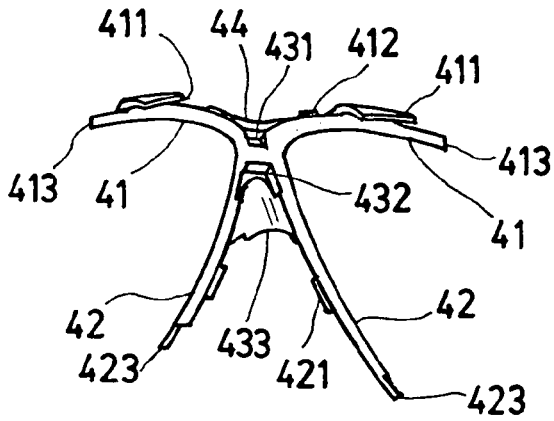
FIG. 5 is a rear view of the clinging device shown in FIG. 4.

FIGS. 2 to 7 show a swim mask constructed according to a preferred embodiment of the present invention including a skirt 10, two lenses 20, a frame 30, and a clinging device 40.

The skirt 10 is formed of an elastomeric material, such as silicon rubber. The lens 20 is formed of glass. The skirt 10 and the lenses 20 are formed together by over-molding to form a portion covering the face including eyes and/or nose and having waterproof seal. It is contemplated that the skirt 10 and the lenses 20 can be formed by other techniques, such as adhesive applying. The skirt 10 has two separate annular flanges 11 into which the lenses 20 are fitted.

The frame 30 is formed of flexible material. The flexible frame 30 has a skeleton portion 31 and two endpieces 32 for connecting to a headband as know in the art. In other embodiments, the endpieces 32 may have other forms. The skeleton portion 31 comprises two eye-shaped frame elements 311 capable of communicating with each other, a gap 312 at an upper portion of a bridge and located between the frame elements 311 such that an upper member 313*a* and a separate lower member 313*b* are formed with the gap 312 located therebetween and the eye-shaped frame elements 311 communicate with each other through the gap 312. An annular groove 314 is formed around each of the two frame elements 311. A user may slightly pull an upper portion of either frame member 311 away from a lower portion thereof to enlarge the frame element 311 such that a first frame element 311 communicates with a second frame element 311 through a separable intermediate bridge portion separated by the gap 312 in the frame 30. By pulling the upper portion and lower portion of each of the two frame elements 311, a user thus can mount the skirt 10 (i.e., the flanges 11) in the frame elements 311 or remove the skirt 10.

The clinging device 40 has two upper arms 41 each including a latch 411 extending rearwardly, a tab 412 located between the latch 411 and an interconnection 44 located between the upper arms 41, and an end member 413 located at an open end, two lower arms 42 each have a pad 421, an end member 423 at an open end, and a cut 422 near the end member 423, and a nose portion 43 including an upper projection 431, a lower projection 432, and a cross member 433.

The upper member 313*a* has a curved member 315*a* and a slot 315*b* matingly engaged with the interconnection 44 and the upper projection 431 respectively. The lower member 313*b* has a dent 315*c* and a trough 315*d* matingly engaged with the lower projection 432 and the cross member 433 respectively. Each of the two frame elements 311 have on a top edge thereof first, second and third recesses 315*e*, 315*f*, and 315*g* matingly engaged with the latch 411, the tab 412, and the end member 413 respectively. A lower edge of the frame 30 between the nose portion and a lowest point of the frame element 311 (i.e., the portion corresponds to the lower arm 42), has a cavity 315*h*, a slope 315*j*, and an indentation 315*k* matingly engaged with the pad 421, the cut 422, and the end member 423 respectively. A nose member 315*m* is formed below the lower member 313*b*. A slot 315*d* is formed on the nose member 315*m* matingly engaged with the cross member 433.

Figure 6:
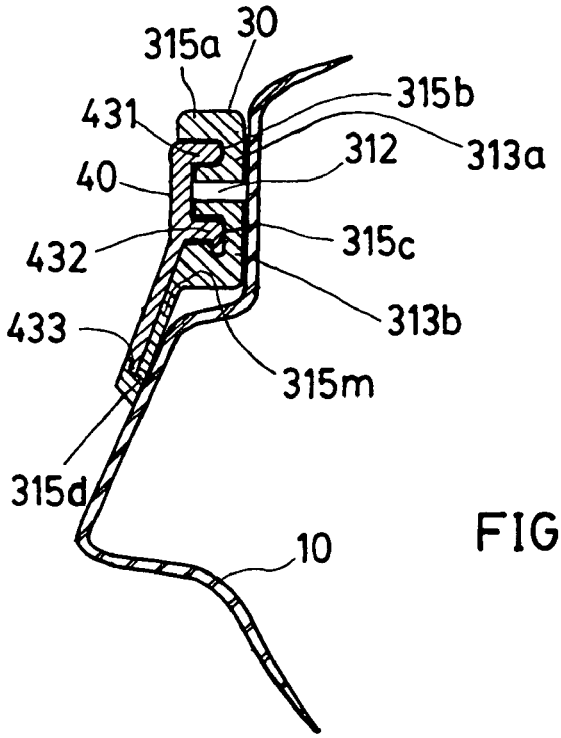
FIGS. 6 and 7 are cross-sectional views taken along lines I—I and II—II of FIG. 2, respectively.

Referring to the cross-sectional view of FIG. 6, the clinging device 40 and the frame 30 are connected together when, the upper projection 431 is inserted into the slot 315*b*, the lower projection 432 is inserted into the dent 315*c*, and the cross member 433 is inserted into the slot 315*d* respectively, thereby fastening the clinging device 40 and the frame 30 together.

Figure 7:
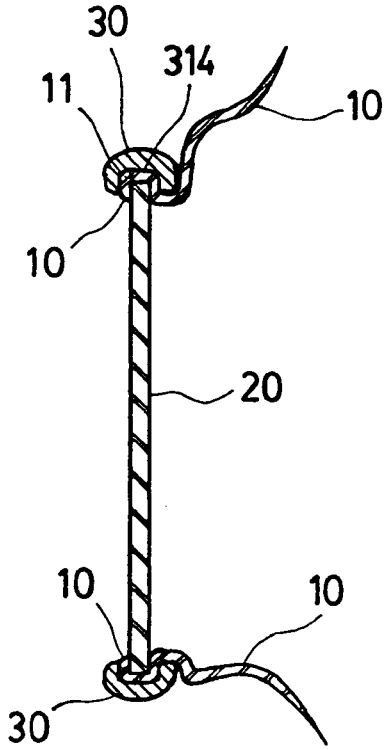

Referring to the cross-sectional view of FIG. 7, the flange 11 is inserted into the groove 314 to fasten the skirt 10 and the frame 30 together.

While the invention discloses herein has been described by means of specific embodiments, numerous modifications and variations could be made thereto by those skilled in the art without departing from the scope and spirit of the invention as set forth in the claims.

What is claimed is:

1. A swim mask with a headband comprising:

a) a frame being flexible and resilient, and having:

i) first and second eye-shaped frame elements, the first eye-shaped frame element communicating with the second eye-shaped frame element;

ii) a separable intermediate portion; and iii) two endpieces located on opposing ends thereof;

b) a unitary skirt inserted into the first and second eye-shaped frame elements and having two lenses; and c) a clinging device removably connected to the separable intermediate portion of the frame and securing the unitary skirt within the frame, wherein, when the clinging device is removed, the unitary skirt is inserted into and removed from the first and second eye-shaped frame elements by separating an upper member and a lower member of the separable intermediate portion of the frame, wherein the lower member has a dent and a trough, the clinging device has a lower projection and a cross member, the lower projection is inserted into the dent and the cross member engaging the trough.

2. The swim mask according to claim 1, wherein each of the first and second eye-shaped frame elements has a first recess, a second recess, and a third recess, the clinging device has two upper arms, each of the two upper arms including a latch, a tab, and an upper end member, one latch engaging each first recess, one tab engaging each second recess, and one upper end member engaging each third recess.

3. The swim mask according to claim 1, wherein each of the first and second eye-shaped frame elements has a cavity, a slope, and an indentation, the clinging device has two upper arms, each of the two upper arms including a pad, a cut, and a lower end member, one pad engaging each cavity, one cut engaging each slope, and one lower end member engaging each indentation.

4. The swim mask according to claim 1, further comprising a gap formed between the first and second eye-shaped frame elements and separating the upper portion and the lower portion of the separable intermediate portion.

5. The swim mask according to claim 1, wherein the clinging device is connected to the upper portion and the lower portion of the separable intermediate portion.

6. The swim mask according to claim 1, wherein the clinging device is connected to edges of the separable intermediate portion of the frame.

* * * * *